US010957259B1

(12) United States Patent
Wei et al.

(10) Patent No.: US 10,957,259 B1
(45) Date of Patent: Mar. 23, 2021

(54) DATA PROCESSING METHOD AND APPARATUS, COMPUTER-READABLE MEDIUM THEREOF

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Xiaolong Wei, Beijing (CN); Wenchao Bao, Beijing (CN); Min He, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 77 days.

(21) Appl. No.: 16/470,662

(22) PCT Filed: Jan. 17, 2019

(86) PCT No.: PCT/CN2019/072156
§ 371 (c)(1),
(2) Date: Jun. 18, 2019

(87) PCT Pub. No.: WO2019/237739
PCT Pub. Date: Dec. 19, 2019

(30) Foreign Application Priority Data

Jun. 15, 2018 (CN) ..... 201810620900.4

(51) Int. Cl.
*G09G 3/3291* (2016.01)

(52) U.S. Cl.
CPC ..... *G09G 3/3291* (2013.01); *G09G 2300/043* (2013.01); *G09G 2310/0243* (2013.01); *G09G 2330/12* (2013.01)

(58) Field of Classification Search
CPC ..... G09G 3/3291; G09G 2300/043; G09G 2310/0243; G09G 2330/12
See application file for complete search history.

(56) References Cited

U.S. PATENT DOCUMENTS 9,035,976 B2 5/2015 Lee et al.
9,715,849 B2 7/2017 Fujii
(Continued)

FOREIGN PATENT DOCUMENTS

CN 103854604 A 6/2014
CN 106935188 A 7/2017
CN 108806609 A 11/2018

OTHER PUBLICATIONS

International Search Report and Written Opinion for International Appl. No. PCT/CN2019/072156, dated Mar. 27, 2019.

*Primary Examiner* — Dmitriy Bolotin
(74) *Attorney, Agent, or Firm* — The Webb Law Firm

(57) ABSTRACT

The embodiment of the present application provides a data processing method, wherein the data processing method is applied to a display panel comprising pixels arranged in an M×N array, the method comprising: obtaining voltage data corresponding to pixels of n adjacent columns in the ith row determining, based on stored voltage data corresponding to pixels of n adjacent columns in (m−1) rows previous to the ith row, whether voltage data corresponding to a pixel in the ith row and jth column is abnormal; performing a filtering process on the voltage data corresponding to the pixel in the ith row and jth column if the voltage data corresponding to the pixel in the ith row and jth column is abnormal, such that a difference between a threshold voltage after the filtering process and an actual threshold voltage is less than or equal to a first threshold difference.

15 Claims, 2 Drawing Sheets

(56) References Cited

U.S. PATENT DOCUMENTS

| | | | | |
|---|---|---|---|---|
| 2005/0168491 | A1* | 8/2005 | Takahara | G09G 3/3241 345/690 |
| 2008/0252569 | A1* | 10/2008 | Kwon | G09G 3/3233 345/76 |
| 2009/0021287 | A1* | 1/2009 | Jang | G09G 3/3233 327/109 |
| 2014/0139510 | A1* | 5/2014 | Han | G09G 3/3233 345/212 |
| 2016/0117982 | A1* | 4/2016 | Fujii | G09G 3/3225 345/211 |
| 2016/0307511 | A1* | 10/2016 | Fujii | G09G 3/20 |
| 2017/0193922 | A1* | 7/2017 | Pyeon | G09G 3/3266 |
| 2017/0337433 | A1* | 11/2017 | Guo | G06K 9/50 |
| 2018/0075798 | A1* | 3/2018 | Nho | G09G 3/32 |
| 2018/0144674 | A1* | 5/2018 | Gupta | G09G 3/3266 |
| 2019/0073969 | A1* | 3/2019 | Li | G09G 3/3677 |
| 2019/0103455 | A1* | 4/2019 | Song | G09G 3/3225 |
| 2019/0295473 | A1* | 9/2019 | Lu | G09G 3/3266 |

* cited by examiner

DATA PROCESSING METHOD AND APPARATUS, COMPUTER-READABLE MEDIUM THEREOF

CROSS REFERENCE TO RELATED APPLICATIONS

The present application is a U.S. National Stage Application under 35 U.S.C. § 371 of International Patent Application No. PCT/CN2019/072156, filed on Jan. 17, 2019, which claims priority to Chinese Patent Application No. 201810620900.4 filed on Jun. 15, 2018, the disclosure of both of which is hereby incorporated by reference in entirety.

TECHNICAL FIELD

The embodiment of the present application relates to the technical field of display, and in particular to a data processing method and an apparatus, and a computer-readable medium thereof.

BACKGROUND

Organic Light-Emitting Diode ("OLED") displays are one of current hotspots in the search field of panel displays. As compared with Liquid Crystal Displays ("LCDs"), OLED displays are advantageous for its low energy consumption, low production cost, self-luminance, wide viewing angle and rapid response speed. At present, in display fields of mobile phones, tablet computers, digital cameras and the like, OLED displays have started to replace traditional LCD displays.

Different from LCDs that control brightness using a stable voltage, OLEDs are driven by a current, so a stable current is required to control the luminance thereof. Generally, OLED displays output the current to OLEDs by drive transistors in a pixel driving circuit in each of pixels so as to drive the OLEDs to emit light. Due to inconsistency in electrical characteristics of the drive transistors in the OLED display, there is a difference in brightness among the pixel units. In order to solve the technical problem of inconsistency in brightness caused by the inconsistency in the electrical characteristics of the drive transistors, an external compensation method is proposed in the prior art, which detects a source voltage of a drive transistor corresponding to each of the pixel units and generates a corrected drive voltage in order to ensure consistency in contents displayed by the OLED display.

SUMMARY

In a first aspect, the embodiment of the present application provides a data processing method, the data processing method being applied to a display panel that comprises pixels arranged in an M×N array, the data processing method comprising:

obtaining voltage data corresponding to pixels of n adjacent columns in the ith row being currently displayed, wherein the voltage data is used for calculating a threshold voltage of a drive transistor corresponding to each of the pixels, the n adjacent columns including the (j−n+1)th column, . . . the (j−1)th column and the jth column, wherein $n-1<j\leq N$, $1<n\leq N$;

determining, based on stored voltage data corresponding to pixels of n adjacent columns in (m−1) rows previous to the ith row, whether voltage data corresponding to a pixel in the ith row and jth column is abnormal, wherein $m-1<i\leq M$, $1<m<M$;

performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference.

According to the embodiment of the present application, the voltage data corresponding to the pixel in the ith row and jth column comprises a source voltage of a drive transistor corresponding to the pixel in the ith row and jth column.

According to the embodiment of the present application, determining, based on the stored voltage data corresponding to the pixels of n adjacent columns in (m−1) rows previous to the ith row, whether the voltage data corresponding to the pixel in the ith row and jth column is abnormal comprises:

calculating and obtaining a feature value based on voltage data corresponding to pixels of n adjacent columns in the ith row and voltage data corresponding to pixels of n adjacent columns in (m−1) rows previous to the ith row;

determining, based on the voltage data corresponding to the pixel in the ith row and jth column and the feature value, whether the voltage data corresponding to the pixel in the ith row and jth column is abnormal.

According to the embodiment of the present application, the feature value is an average or a weighted average, and when the feature value is a weighted average, a weight corresponding to a pixel closer to the pixel in the ith row and jth column is larger.

According to the embodiment of the present application, determining, based on the voltage data corresponding to the pixel in the ith row and jth column and the feature value, whether the voltage data corresponding to the pixel in the ith row and jth column is abnormal comprises:

determining whether a difference between the voltage data corresponding to the pixel in the ith row and jth column and the feature value is greater than a second threshold difference, and if the difference between the voltage data corresponding to the pixel in the ith row and jth column and the feature value is greater than the second threshold difference, determining that the voltage data corresponding to the pixel in the ith row and jth column is abnormal.

According to the embodiment of the present application, the second threshold difference is K times the feature value, wherein $0.1\leq K\leq 0.2$.

According to the embodiment of the present application, performing the filtering process on the voltage data corresponding to the pixel in the ith row and jth column comprises: modifying the voltage data corresponding to the pixel in the ith row and jth column to the feature value.

According to the embodiment of the present application, the data processing method further comprises:

storing voltage data corresponding to pixels of the n adjacent columns in the (i+1)th row when pixels in the (i+1)th row are displayed.

According to the embodiment of the present application, the data processing method further comprises: compensating the pixel in the ith row and jth column based on the modified voltage data corresponding to the pixel in the ith row and jth column.

In a second aspect, the embodiment of the present application provides a data processing apparatus, the data processing apparatus being applied to a display panel that comprises pixels arranged in an M×N array, the data processing apparatus comprising:

an obtaining circuit configured for obtaining voltage data corresponding to pixels of n adjacent columns in the ith row being currently displayed, wherein the voltage data is used for calculating a threshold voltage of a drive transistor corresponding to each of the pixels, the n adjacent columns including the (j−n−1)th column, . . . the (j−1)th column and the jth column, wherein $n-1<j\leq N$, $1\leq n\leq N$;

a determining circuit configured for determining, based on stored voltage data corresponding to pixels of n adjacent columns in (m−1) rows previous to the ith row, whether voltage data corresponding to a pixel in the ith row and jth column is abnormal, wherein $m-1<i\leq M$, $1<m<M$; and a filtering circuit configured for performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference.

According to the embodiment of the present application, the data processing apparatus further comprises (m−1) storage circuits;

wherein the kth storage circuit is used for storing voltage data corresponding to pixels of n adjacent columns in the (i−m+k)th row, wherein $1\leq k\leq m-1$.

According to the embodiment of the present application, the determining circuit is used for calculating and obtaining a feature value based on voltage data corresponding to pixels of n adjacent columns in the ith row and voltage data corresponding to pixels of n adjacent columns in (m−1) rows previous to the ith row; determining whether a difference between the voltage data corresponding to the pixel in the ith row and jth column and the feature value is greater than a second threshold difference, and if the difference between the voltage data corresponding to the pixel in the ith row and jth column and the feature value is greater than the second threshold difference, determining that the voltage data corresponding to the pixel in the ith row and jth column is abnormal.

According to the embodiment of the present application, the filtering circuit is used for modifying the voltage data corresponding to the pixel in the ith row and jth column to the feature value.

According to the embodiment of the present application, voltage data corresponding to pixels of n adjacent columns in the (i+1)th row are stored in the (m−1)th storage circuit when pixels in the (i+1)th row are displayed, and data stored in the kth storage circuit are inputted to the (k−1)th storage circuit in a manner of a data stream to replace data stored in the (k−1)th storage circuit.

In a third aspect, the embodiment of the present application further provides a computer-readable medium having stored thereon computer programs operable on a processor, the computer programs, when executed by the processor, implement the data processing method as discussed above.

The embodiment of the present application provides a data processing method and an apparatus and a computer-readable storage medium thereof, wherein the data processing method is applied to a display panel comprising pixels arranged in an M×N array, the data processing method comprising: obtaining voltage data corresponding to pixels of n adjacent columns in the ith row being currently displayed; determining, based on stored voltage data corresponding to pixels of n adjacent columns in (m−1) rows previous to the ith row, whether voltage data corresponding to a pixel in the ith row and jth column is abnormal; performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference.

Other characteristics and advantages of the present application will be described thereafter in the description, and will partially become obvious from the description, or be understood by implementing the present application. The object and other advantages of the present application may be implemented and obtained by means of the structures indicated specifically in the description, claims, and appending drawings.

BRIEF DESCRIPTION OF THE DRAWINGS

The drawings are used to provide further understandings of and form a part of the technical solution of the present application, and together with the embodiments of the present application, are used to explain the technical solution of the present application, but shall not constitute limitations on the technical solution of the present application.

DETAILED DESCRIPTION

In order to make the purpose, technical solution and advantages of the present application clearer, the embodiments of the present application will be described in detail below with reference to the drawings. It is to be noted that, without conflictions, the embodiments and the features in the embodiments of the present application can be combined arbitrarily.

The steps shown in the flow chart of the drawings may be executed in, for example, a computer system comprising a set of computer-executable instructions. Furthermore, although a logical sequence is shown in the flow chart, under certain circumstances, the steps as shown or described may be performed in a sequence different from that.

Unless otherwise defined, technological terms or scientific terms used in the embodiments of the present application shall have meanings as commonly understood by those ordinary technicians skilled in the field to which the present invention pertains. The terms "first", "second" and similar wordings used in the embodiments of the present application do not mean any order, quantity or importance, but are used only to discriminate different constituents. A term such as "comprising" or "including" means the element or article appearing before said term contain the element or article appearing after said term and equivalents thereof, without exclusion of other elements or articles. A term such as "connected" or "interconnected" is not limited to a physical or mechanical connection, but may include an electrical connection, either directly or indirectly.

The OLED external compensation technique generates a corrected drive voltage based on characteristic parameters of a drive transistor DTFT in a pixel drive circuit connected to each of the pixels, thereby solving the problem of inconsistency in brightness caused by inconsistency in TFT electrical characteristics. The threshold voltage Vth of the drive transistor DTFT is a very important electrical parameter in the OLED external compensation technique.

After studying, the applicant found that if a short circuiting occurs in the OLED display, a bright point will appear after the external compensation is performed thereon, which would affect the display effect of the OLED display.

Figure 1:
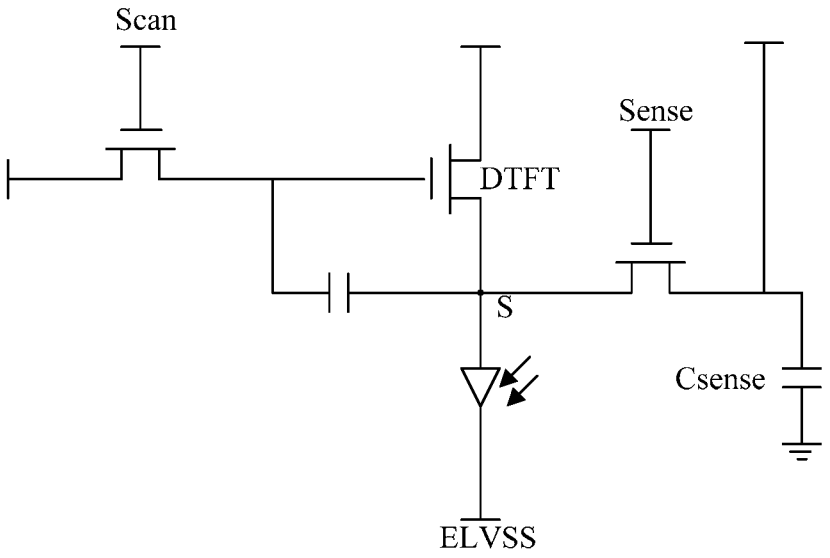
FIG. 1 is an equivalent circuit diagram showing an existing pixel drive circuit connected to a pixel.

FIG. 1 is an equivalent circuit diagram showing an existing pixel drive circuit connected to a pixel. As shown in FIG. 1, a drive voltage loaded on a gate electrode of the drive transistor DTFT is Vg, and a source voltage for initializing the drive transistor DTFT is Vs; an open signal is inputted to a scan signal end "Scan" and a sense signal end "Sense"; when a difference between Vg and Vs is greater than the threshold voltage of the drive transistor DTFT, the drive transistor DTFT is opened, a current flows through the drive transistor DTFT to charge a capacitor "Csense", and a voltage of a node S is then elevated; as the charging time increases, the drive transistor DTFT is in an OFF state when the voltage of the node S is no longer elevated. At a present stage, a method for extracting the threshold voltage Vth is as follows: detecting the source voltage of the drive transistor DTFT, and obtaining the threshold voltage of the drive transistor DTFT by a formula Vth=Vg−Vs.

Figure 2:
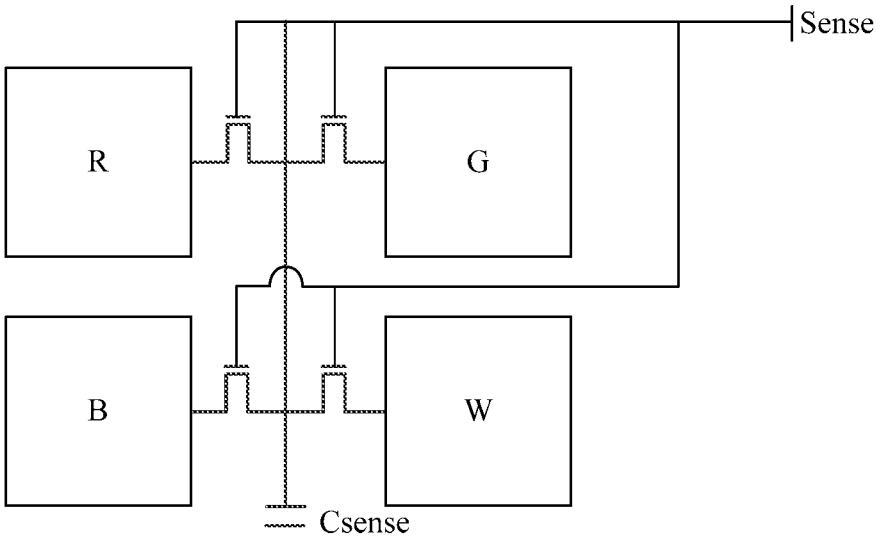
FIG. 2 is a schematic diagram showing the structure of existing pixels.

FIG. 2 is a schematic diagram showing the structure of existing pixels. Each of the pixels includes 3 or 4 subpixels. In FIG. 2, it is exemplified that each of the pixels includes four subpixels, namely, an R subpixel, a G subpixel, a B subpixel and a W subpixel. With reference to FIGS. 1 and 2, the four subpixels are all connected to the sense signal end "Sense". When a node S of any subpixel of RGBW (it is assumed to be the R subpixel) is short-circuited to a low-level power source end "ELVSS", prior to the external compensation for the display panel, the subpixel is displayed as a dark point, and the G subpixel, the B subpixel and the W subpixel are normally displayed. However, since the node S of the R subpixel is short-circuited to the low-level power source end "ELVSS", the capacitor "Csense" cannot be normally charged. At this time, the threshold voltage of the drive transistor DTFT is calculated as Vth=Vg−0, which is greater than the actual threshold voltage of the drive transistor DTFT. Upon completion of the external compensation for the display panel, the G subpixel, the B subpixel and the W subpixel of the pixel, when being displayed, have a brightness higher than that of surrounding pixels, so it is displayed as a bright point, and thus affects the display effect of the display panel.

In order to solve the above technical problem, the embodiment of the present application provides a data processing method as well as an apparatus and a computer-readable medium thereof, thereby avoiding bright points from appearing after the external compensation for the OLED display, and thus improving the display effect of the OLED display.

According to the technical solution provided by the embodiment of the present application, it is determined whether voltage data corresponding to currently displayed pixels is abnormal, and in case of abnormality, a filtering process is performed thereon to ensure that a threshold voltage calculated based on the voltage data after the filtering process is close to the actual threshold voltage, thereby eliminating newly added bright points after the compensation for the display panel, and thus improving the display effect of the display panel.

Figure 3:
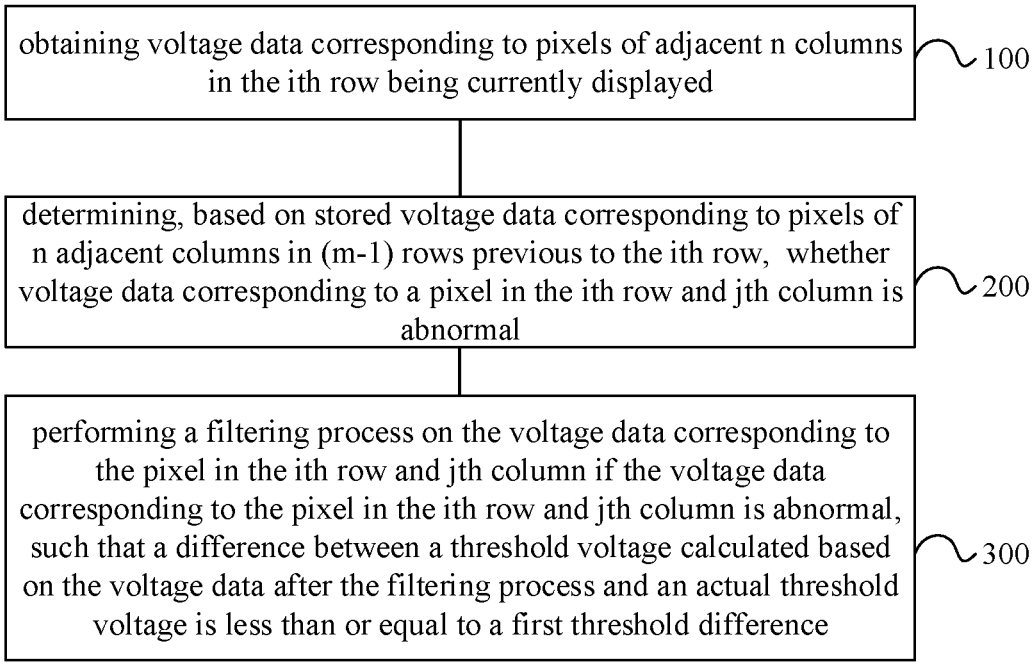
FIG. 3 is a flow chart showing a data processing method provided by the embodiment of the present application.

FIG. 3 is a flow chart showing a data processing method provided by the embodiment of the present application. As shown in FIG. 3, the data processing method provided by the embodiment of the present application is applied to a display panel that comprises pixels arranged in an M×N array, the data processing method provided by the embodiment of the present application comprising the following steps:

Step 100: obtaining voltage data corresponding to pixels of n adjacent columns in the ith row being currently displayed.

According to the embodiment of the present application, the voltage data is used for calculating a threshold voltage of a drive transistor corresponding to each of the pixels. For example, the voltage data may include a source voltage of the drive transistor corresponding to the pixel.

For example, n adjacent columns may include the (j−n+1)th column, . . . the (j−1)th column and the jth column, wherein $n-1<j\leq N$, $1\leq n\leq N$. It needs to be noted that the value of n may be determined according to practical need, and the embodiment of the present application does not set any limitation thereon.

For example, the voltage data corresponding to pixels of n adjacent columns in the ith row being currently displayed is sample data outputted from a drive IC in the display panel.

Step 200: determining, based on stored voltage data corresponding to pixels of n adjacent columns in (m−1) rows previous to the ith row, whether voltage data corresponding to a pixel in the ith row and jth column is abnormal.

According to the embodiment of the present application, (m−1) rows previous to the ith row may refer to the (i−1)th row, the (i−2)th row, . . . , the (i−m+1)th row.

For example, $m-1<i\leq M$, $1\leq m\leq M$. It needs to be noted that the value of n may be determined according to practical need, and the embodiment of the present application does not set any limitation thereon.

For example, n adjacent columns in the stored n adjacent columns in (m−1) rows previous to the ith row include the (j−n+1)th column, . . . the (j−1)th column and the jth column, including a number of columns identical with that of n adjacent columns in the ith row as obtained.

Step 300: performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference.

For example, if the voltage data corresponding to the pixel in the ith row and jth column is not abnormal, the pixel in the ith row and jth column is compensated based on the voltage data corresponding to the pixel in the ith row and jth column.

The value of the first threshold difference may be determined according to practical need, and the embodiment of the present application does not set any limitation thereon.

The data processing method provided by the embodiment of the present application is applied to a display panel comprising pixels arranged in an M×N array, the data processing method comprising: obtaining voltage data corresponding to pixels of n adjacent columns in the ith row being currently displayed; determining, based on stored voltage data corresponding to pixels of n adjacent columns in (m−1) rows previous to the ith row, whether voltage data corresponding to a pixel in the ith row and jth column is abnormal; performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference. According to the technical solution provided by the embodiment of the present application, it is determined whether voltage data corresponding to currently displayed pixels is abnormal, and in case of abnormality, a filtering process is performed thereon to ensure that a threshold voltage calculated based on the voltage data after the filtering process is close to the actual threshold voltage, thereby eliminating newly added bright points after the compensation for the display panel, and thus improving the display effect of the display panel.

According to the embodiment of the present application, Step 200 may include: calculating and obtaining a feature value based on voltage data corresponding to pixels of n adjacent columns in the ith row and voltage data corresponding to pixels of n adjacent columns in (m−1) rows previous to the ith row; determining whether the voltage data corresponding to the pixel in the ith row and jth column is abnormal based on the voltage data corresponding to the pixel in the ith row and jth column and the feature value.

According to the embodiment of the present application, the feature value is an average or a weighted average.

It needs to be noted that with change of the number of rows of pixels being currently displayed, the feature value is a data that is updated in real time. When the feature value is a weighted average, a weight corresponding to a pixel closer to the pixel in the ith row and jth column is larger. In other words, a weight corresponding to the pixel in the ith row and jth column is larger than a weight corresponding to the pixel in the ith row and (j−1)th column, a weight corresponding to the pixel in the ith row and (j−1)th column is larger than a weight corresponding to the pixel in the ith row and (j−2)th column, and so on, and a weight corresponding to the pixel in the (i−m+1)th row and (j−n+1)th column is minimum.

In consideration of the fact that voltage data corresponding to pixels of the display panel are real-time, in the embodiment of the present application, it is set that the weight of voltage data close to those to be filtered is larger than the weight of other data, such that a threshold voltage calculated based on voltage data after the filtering process approaches the actual threshold voltage as close as possible, thereby eliminating newly added bright points after the compensation for the display panel to the greatest extent.

According to the embodiment of the present application, determining, based on the voltage data corresponding to the pixel in the ith row and jth column and the feature value, whether the voltage data corresponding to the pixel in the ith row and jth column is abnormal may include: determining whether a difference between the voltage data corresponding to the pixel in the ith row and jth column and the feature value is greater than a second threshold difference, and if the difference between the voltage data corresponding to the pixel in the ith row and jth column and the feature value is greater than the second threshold difference, determining that the voltage data corresponding to the pixel in the ith row and jth column is abnormal.

For example, the second threshold difference is K times the feature value, wherein $0.1 \leq K \leq 0.2$.

It needs to be noted that the value of K is determined based on a discreteness of sample data. The more discrete the data is, the greater the value of K is. For example, the value of K may be adjusted according to practical use, and the embodiment of the present application does not set any limitation thereon.

It needs to be noted that as the number of rows of the pixels being currently displayed is updated, the feature value is also updated, and correspondingly, the second threshold difference will be also updated. Based on the replaced threshold voltage, a normal compensation process is performed on the pixel.

According to the embodiment of the present application, the second threshold difference is set to be a data that is updated in real time, and thus, differences among drive transistors in the display panel are considered. The pixel driving circuit has a capacitance in a large range, and if the second threshold difference is set to be too small, an erroneous filtering process may be performed on the voltage data, such that normal voltage data may also be filtered out, while if the second threshold difference is set to be too large, it cannot be ensured that all abnormal voltage data are filtered out.

According to the embodiment of the present application, Step 300 includes: modifying the voltage data corresponding to the pixel in the ith row and jth column to the feature value.

According to the embodiment of the present application, the data processing method further comprises, after Step 300: storing the modified voltage data corresponding to the pixels of n adjacent columns in the ith row.

According to the embodiment of the present application, the data processing method provided by the embodiment of the present application further comprises, after Step 300:

compensating the pixel in the ith row and jth column based on the modified voltage data corresponding to the pixel in the ith row and jth column.

The obtained voltage data corresponding to the pixels of the n adjacent columns in the ith row being currently displayed and the stored voltage data corresponding to the pixels of n adjacent columns in (m−1) rows previous to the ith row as provided by the embodiment of the present application actually form an m×n local filter window, wherein the data in the mth row in the local filter window is voltage data sampled and outputted by the driving IC on the pixels of the n adjacent columns in the ith row being currently displayed.

The process of the data processing method is illustrated with an example in which m=3, n=3: when the first row is displayed on the display panel, voltage data corresponding to pixels of three adjacent columns (such as the first, the second and the third columns) in the first row are obtained and stored; when the second row is displayed, voltage data corresponding to pixels of the first, the second and the third columns in the second row are obtained and stored; when the third row is displayed, voltage data corresponding to pixels of the first, the second and the third columns in the third row are obtained; an average or a weighted average of the stored voltage data corresponding to the pixels of the three adjacent columns in the first row, the pixels of the three adjacent columns in the second row and the pixels of the three adjacent columns in the third row are calculated and serve as a feature value; if a difference between the voltage data corresponding to the pixel in the third row and third column and the feature value is greater than a second threshold difference, it is determined that the voltage data corresponding to the pixel in the third row and third column is abnormal, and the voltage data corresponding to the third row and third column is replaced by the feature value; when the fourth row is displayed, voltage data corresponding to pixels of the first, the second and the third columns in the fourth row is obtained; an average or a weighted average of the stored voltage data corresponding to the pixels of the three adjacent columns in the second row, the pixels of the three adjacent columns in the third row and the pixels of the three adjacent columns in the fourth row is calculated, and it is determined whether the voltage data corresponding to the pixel in the fourth row and third column is abnormal; if it is abnormal, the voltage data corresponding to the fourth row and third column is replaced by the feature value, and so on, until scanning of all rows of pixels is completed.

Figure 4:
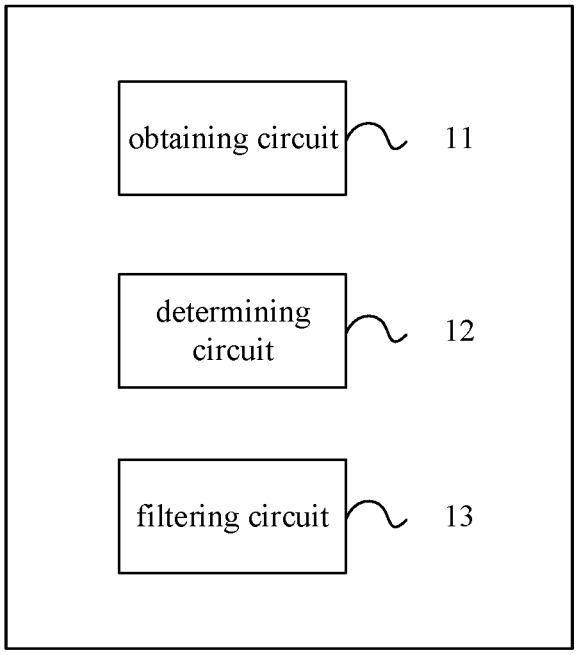
FIG. 4 is a schematic diagram showing the structure of a data processing apparatus provided by the embodiment of the present application.

Based on the concept of the above embodiment, the embodiment of the present application further provides a data processing apparatus, the data processing apparatus being applied to a display panel that comprises pixels arranged in an M×N array. FIG. 4 is a schematic diagram showing the structure of a data processing apparatus provided by the embodiment of the present application. As shown in FIG. 4, the data processing apparatus provided by the embodiment of the present application comprises: an obtaining circuit 11, a determining circuit 12 and a filtering circuit 13.

According to the embodiment of the present application, the obtaining circuit 11 is used for obtaining voltage data corresponding to pixels of n adjacent columns in the ith row being currently displayed.

The voltage data is used for calculating a threshold voltage of a drive transistor corresponding to each of the pixels. For example, the voltage data may include a source voltage of the drive transistor corresponding to the pixel.

For example, n adjacent columns may include the (j−n+1)th column, . . . the (j−1)th column and the jth column, wherein $n-1<j\leq N$, $1\leq n\leq N$. It needs to be noted that the value of n may be determined according to practical need, and the embodiment of the present application does not set any limitation thereon.

The determining circuit 12 is used for determining, based on stored voltage data corresponding to pixels of n adjacent columns in (m−1) rows previous to the ith row, whether voltage data corresponding to pixel in the ith row and jth column is abnormal.

In the embodiment, (m−1) rows previous to the ith row may refer to the (i−1)th row, the (i−2)th row, . . . , the (i−m+1)th row, wherein $m-1<i\leq M$, $1\leq m\leq M$. It needs to be noted that the value of n may be determined according to practical need, and the embodiment of the present application does not set any limitation thereon.

For example, the determining circuit 12 is used for calculating and obtaining a feature value based on voltage data corresponding to pixels of n adjacent columns in the ith row and voltage data corresponding to pixels of n adjacent columns in (m−1) rows previous to the ith row; determining whether a difference between the voltage data corresponding to the pixel in the ith row and jth column and the feature value is greater than a second threshold difference, and if the difference between the voltage data corresponding to the pixel in the ith row and jth column and the feature value is greater than the second threshold difference, determining that the voltage data corresponding to the pixel in the ith row and jth column is abnormal.

The filtering circuit 13 is used for performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference.

For example, if the voltage data corresponding to the pixel in the ith row and jth column is not abnormal, the pixel in the ith row and jth column is compensated based on the voltage data corresponding to the pixel in the ith row and jth column.

The value of the first threshold difference may be determined according to practical need, and the embodiment of the present application does not set any limitation thereon.

For example, the filtering circuit is used for modifying the voltage data corresponding to the pixel in the ith row and jth column to the feature value.

The data processing apparatus provided by the embodiment of the present application is applied to a display panel comprising pixels arranged in an M×N array, the data processing apparatus comprising: an obtaining circuit used for obtaining voltage data corresponding to pixels of n adjacent columns in the ith row being currently displayed; a determining circuit used for determining, based on stored voltage data corresponding to pixels of n adjacent columns in (m−1) rows previous to the ith row, whether voltage data corresponding to a pixel in the ith row and jth column is abnormal; and a filtering circuit used for performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference. According to the technical solution provided by the embodiment of the present application, it is determined whether voltage data corresponding to currently displayed pixels is abnormal, and in case of abnormality, a filtering process is performed thereon to ensure that a threshold voltage calculated based on the voltage data after the filtering process is close to the actual threshold voltage, thereby eliminating newly added bright points after the compensation for the display panel, and thus improving the display effect of the display panel.

According to the embodiment of the present application, the data processing apparatus provided by the embodiment of the present application further comprises (m−1) storage circuits, wherein the kth storage circuit is used for storing voltage data corresponding to pixels of n adjacent columns in the (i−m+k)th row, wherein $1\leq k\leq m-1$.

According to the embodiment of the present application, the storage circuit comprises a row buffer.

According to the embodiment of the present application, voltage data corresponding to pixels of n adjacent columns in the (i+1)th row are stored in the (m−1)th storage circuit when pixels in the (i+1)th row are displayed, i.e., when the display panel displays pixels in the next row, and data stored in the kth storage circuit are inputted to the (k−1)th storage circuit in a manner of a data stream to replace data stored in the (k−1)th storage circuit.

For example, when pixels in the ith row are currently displayed, data in (m−1) storage circuits and voltage data corresponding to pixels of n adjacent columns in the ith row being currently sampled and outputted by the driving IC are obtained, and after completion of the filtering, data in the second storage circuit is inputted to the first storage circuit in a manner of a data stream, data in the third storage circuit is inputted to the second storage circuit in a manner of a data stream, and voltage data corresponding to pixels of n adjacent columns in the ith row being currently sampled and outputted by the driving IC are inputted to the (m−1)th storage circuit in a manner of a data stream.

Based on the concept of the above example, the embodiment of the present application further provides a computer-readable storage medium having stored thereon computer programs operable on a processor, the computer programs, when executed by the processor, implement the data processing method provided by the embodiment of the present application.

It can be understood by ordinary technicians in the art that all or certain steps in the method provided in the context and functional modules/units in the system and apparatus may be implemented as software, firmware, hardware and suitable combinations thereof. In a hardware embodiment, a division of the functional modules/units as described above may not correspond to a division of physical components. For example, one physical component may have multiple functions, or one function or step may be implemented by several physical components in cooperation. Certain or all components may be implemented as software executed by a processor, such as a digital signal processor or a microprocessor, or be implemented as hardware, or as an integrated circuit, such as an ASIC. Such software may be distributed on a computer-readable medium, which may include a computer storage medium (or a non-transitory medium) and a communication medium (or a transitory medium). As commonly known to ordinary technicians in the art, the term "a computer storage medium" includes volatile and non-volatile, removable and non-removable media implemented in any method or technique for storing information (such as computer-readable instructions, data structures, program modules or other data). The computer storage medium includes, but is not limited to, a RAM, a ROM, an EEPROM, a flash or another storage technique, a CD-ROM, a digital versatile disc (DVD) or another optical disc storage, a magnetic box, a tape, a disc storage or another magnetic storage device, or any other medium that can be used for storing the desired information and is accessible by a computer. In addition, it is well known to ordinary technicians in the art that a communication medium usually includes computer-readable instructions, data structures, program modules or other data in a modulated data signal such as carriers or other transmission mechanisms and may include any information delivery medium.

The drawings in the embodiment of the present application only relate to structures involved in the embodiment of the present application, and for other structures, one may refer to common designs.

Without confliction, examples of the present application, i.e., features in the embodiment, may be combined with each other to form new embodiments.

Although the embodiments revealed by the present application are as mentioned above, the contents are only embodiments to facilitate understandings on the present application but shall not limit the present application. Those skilled in the art may make any amendment and modification in terms of the form and detail of the implementation of the present application without departing from spirits and scope revealed by the present application, but the scope of patent protection sought for in the present application shall be defined by the attached claims.

What is claimed is:

1. A data processing method, the data processing method being applied to a display panel that comprises pixels arranged in an M×N array, the data processing method comprising:

obtaining voltage data corresponding to pixels of n adjacent columns in the ith row being currently displayed, wherein the voltage data is used for calculating a threshold voltage of a drive transistor corresponding to each of the pixels, the n adjacent columns including the (j−n+1)th column, . . . the (j−1)th column and the jth column, wherein $n-1<j\leq N$, $1\leq n\leq N$;

determining, based on stored voltage data corresponding to pixels of n adjacent columns in (m−1) rows previous to the ith row, whether voltage data corresponding to a pixel in the ith row and jth column is abnormal, wherein $m-1<i\leq M$, $1<m<M$; and performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference.

2. The data processing method according to claim 1, wherein the voltage data corresponding to the pixel in the ith row and jth column comprises a source voltage of the drive transistor corresponding to the pixel in the ith row and jth column.

3. The data processing method according to claim 1, wherein determining, based on the stored voltage data corresponding to the pixels of the n adjacent columns in (m−1) rows previous to the ith row, whether the voltage data corresponding to the pixel in the ith row and jth column is abnormal comprises:

calculating and obtaining a feature value based on voltage data corresponding to pixels of n adjacent columns in the ith row and voltage data corresponding to pixels of n adjacent columns in (m−1) rows previous to the ith row; and determining, based on the voltage data corresponding to the pixel in the ith row and jth column and the feature value, whether the voltage data corresponding to the pixel in the ith row and jth column is abnormal.

4. The data processing method according to claim 3, wherein the feature value is an average or a weighted average, and when the feature value is a weighted average, a weight corresponding to a pixel closer to the pixel in the ith row and jth column is larger.

5. The data processing method according to claim 3, wherein determining, based on the voltage data corresponding to the pixel in the ith row and jth column and the feature value, whether the voltage data corresponding to the pixel in the ith row and jth column is abnormal comprises:

determining whether a difference between the voltage data corresponding to the pixel in the ith row and jth column and the feature value is greater than a second threshold difference, and if the difference between the voltage data corresponding to the pixel in the ith row and jth column and the feature value is greater than the second threshold difference, determining that the voltage data corresponding to the pixel in the ith row and jth column is abnormal.

6. The data processing method according to claim 5, wherein the second threshold difference is K times the feature value, wherein $0.1\leq K\leq 0.2$.

7. The data processing method according to claim 5, wherein performing the filtering process on the voltage data corresponding to the pixel in the ith row and jth column comprises:

modifying the voltage data corresponding to the pixel in the ith row and jth column to the feature value.

8. The data processing method according to claim 7, the data processing method further comprising:

storing voltage data corresponding to pixels of the n adjacent columns in the (i+1)th row when pixels in the (i+1)th row are displayed.

9. The data processing method according to claim 7, the data processing method further comprising:

compensating the pixel in the ith row and jth column based on the modified voltage data corresponding to the pixel in the ith row and jth column.

10. A non-transitory computer-readable medium having stored thereon computer programs operable on a processor, the computer programs, when executed by the processor, implement the data processing method according to claim 1.

11. A data processing apparatus for applying data processing to a display panel that comprises pixels arranged in an M×N array, the data processing apparatus comprising:

an obtaining circuit configured for obtaining voltage data corresponding to pixels of n adjacent columns in the ith row being currently displayed, wherein the voltage data is used for calculating a threshold voltage of a drive transistor corresponding to each of the pixels, the n adjacent columns including the (j−n−1)th column, . . . the (j−1)th column and the jth column, wherein $n-1<j\leq N$, $1\leq n\leq N$;

a determining circuit configured for determining, based on stored voltage data corresponding to pixels of n adjacent columns in (m−1) rows previous to the ith row, whether voltage data corresponding to a pixel in the ith row and jth column is abnormal, wherein $m-1<i\leq M$, $1<m<M$; and a filtering circuit configured for performing a filtering process on the voltage data corresponding to the pixel in the ith row and jth column if the voltage data corresponding to the pixel in the ith row and jth column is abnormal, such that a difference between a threshold voltage calculated based on the voltage data after the filtering process and an actual threshold voltage is less than or equal to a first threshold difference.

12. The data processing apparatus according to claim 11, the data processing apparatus further comprising (m−1) storage circuits;

wherein a kth storage circuit is used for storing voltage data corresponding to pixels of n adjacent columns in the (i−m+k)th row, wherein $1\leq k\leq m-1$.

13. The data processing apparatus according to claim 11, wherein the determining circuit is configured to calculate and obtain a feature value based on the voltage data corresponding to the pixels of n adjacent columns in the ith row and voltage data corresponding to pixels of n adjacent columns in (m−1) rows previous to the ith row; determine whether a difference between the voltage data corresponding to the pixel in the ith row and jth column and the feature value is greater than a second threshold difference, and if the difference between the voltage data corresponding to the pixel in the ith row and jth column and the feature value is greater than the second threshold difference, and determine that the voltage data corresponding to the pixel in the ith row and jth column is abnormal.

14. The data processing apparatus according to claim 13, wherein the filtering circuit is configured to modify the voltage data corresponding to the pixel in the ith row and jth column to the feature value.

15. The data processing apparatus according to claim 11, wherein voltage data corresponding to pixels of n adjacent columns in the (i+1)th row are stored in the (m−1)th storage circuit when pixels in the (i+1)th row are displayed, and data stored in the kth storage circuit are inputted to the (k−1)th storage circuit in a manner of a data stream to replace data stored in the (k−1)th storage circuit.

* * * * *